United States Patent [19]

Pettit

[11] Patent Number: 4,634,152

[45] Date of Patent: Jan. 6, 1987

[54] CASING HANGER RUNNING TOOL

[75] Inventor: John Pettit, Camarillo, Calif.

[73] Assignee: Vetco Offshore Industries, Inc., Ventura, Calif.

[21] Appl. No.: 727,491

[22] Filed: Apr. 26, 1985

[51] Int. Cl.[4] ..... F16L 55/00

[52] U.S. Cl. ..... 285/39; 285/133.2; 285/140; 166/382

[58] Field of Search ..... 285/18, 39, 133.2, 140, 285/141, 142; 166/382, 387, 124, 208, 182

[56] References Cited

U.S. PATENT DOCUMENTS

| | | | |
|---|---|---|---|
| 3,468,558 | 9/1969 | Ahlstone | 285/18 |
| 3,468,559 | 9/1969 | Ahlstone | 285/18 |
| 3,489,436 | 1/1970 | Ahlstone | 285/18 |
| 3,492,026 | 1/1970 | Ahlstone | 285/18 |
| 3,797,864 | 3/1974 | Hynes et al. | 285/140 |
| 3,837,684 | 9/1974 | Hynes | 285/18 X |
| 3,871,449 | 3/1975 | Ahlstone | 285/140 X |
| 3,913,670 | 10/1975 | Ahlstone | 166/182 |
| 3,924,679 | 12/1975 | Jansen | 166/182 |

*Primary Examiner*—Richard J. Scanlan, Jr.
*Attorney, Agent, or Firm*—Joseph R. Dwyer

[57] ABSTRACT

A running tool (20) comprising a stem (22) with a plug (40), a running nut (30), a wedge (32), a cam ring (34), and a bottom nut (36) together releasably connect and support a casing hanger (12), wear bushing (14) and packoff assembly (16) thereon. The bottom nut (36) supports the cam ring (34) and is wedged into engagement with the casing hanger (12) by downward axial movement of the running nut (30). A packoff assembly (16) is threaded on the casing hanger (12) and arranged so that rotation of the plug (40) and stem (22) rotates the wear bushing (14) and the packoff assembly (16) to set the packoff.

The casing hanger (12), wear bushing (14) and packoff assembly (16) are lowered on the running tool (20) into final position within the wellhead. The running tool (20) is released by rotation of the stem (22) which raises the running nut (30), disengages the wedge (32) and allowing the cam ring (34) to disengage the casing hanger (12). A dead band between the wedge (32) and running nut (30) prevents accidental release of the running tool (30) form the casing hanger (12), and on further rotation, the running nut (30) becomes a driving element for threading the packoff assembly (16) so as to set the packoff.

Important features of the invention include releasability of the running tool (20) before setting the packoff, if necessary, the aforementioned safety feature, and the capability of releasing the running nut (30) upon the application of low torque after the application of high torque thereto as a driving element.

17 Claims, 10 Drawing Figures

CASING HANGER RUNNING TOOL

BACKGROUND OF THE INVENTION

The present invention relates, in general, to subsea well apparatus and is directed specifically to subsea well apparatus such that in only one trip between the vessel or platform on the water surface and the subsea well, a casing string is run into the well bore and cemented in place, a wear bushing is positioned within the well bore for protecting the surrounding wellhead during subsequent drilling operations, and the annular seal region between a casing hanger body and the surrounding wellhead bore is sealed and tested.

Still more specifically, this invention improves such apparatus by providing in such apparatus means by which the running tool can be released rapidly prior to moving the seal into the annular seal region and means by which the wear bushing is positioned in its final operating position when the apparatus is initially landed in the well bore. Also included in the means for rapid release of the running tool is means for releasing the drive elements of the running tool upon application of low torque and a safety feature to prevent accidental release of the running tool for the casing hanger.

In the drilling of oil and gas wells at an underwater location, a casing string is run into a well bore, and supported by a casing hanger (also referred to as hanger body) resting on complementary seats within a surrounding wellhead. After the casing string is cemented in place, a suitable seal assembly, referred to as a packoff assembly, is actuated (energized) to packoff (seal) the annular seal region between the exterior of the casing hanger and the surrounding wellhead for later drilling operations to take place within the wellhead. Energizing the packoff (seal) is also referred to as setting the packoff. Apparatus for such operations is illustrated in a number of U.S. patents, such as, for example, U.S. Pat. Nos. 3,313,030, 3,468,558, 3,468,559, 3,489,436, 3,492,026, 3,797,864 and 3,871,449. These patents not only show examples of casing hangers (hanger bodies), axially deformable elastomeric packing seals (packoff assemblies), and seat protectors (now called wear bushings depending on their function, although in these patents the terms were used interchangeably), but they also show the seat protectors being lowered into position in one trip of the running tool between the vessel or platform and the well. However, none of the patents show a seat protector (wear bushing) positioned in its final position upon landing of the running tool in the well bore. A lowering of the seat protector (wear bushing) into place was required later. Reference is also made to the U.S. patent application of Goris and Pettit, Ser. No. 719,383, filed Apr. 2, 1985 now U.S. Pat. No. 4,611,663 entitled "Casing Hanger and Running Apparatus", which discloses apparatus in which seating the casing hanger within the wellhead, cementing the casing hanger in place, packing off the seal region and pressure testing off the seal for leakage is accomplished in one trip between the vessel or platform and the well. However, no wear bushing is disclosed in this referenced application.

SUMMARY OF THE INVENTION

This invention includes a running tool comprising a stem with a plug, a running nut, a wedge, a cam ring, and a bottom nut which together releasably connect and support a casing hanger, wear bushing, and packoff assembly thereon. The bottom nut threaded on the stem supports the cam ring which is externally profiled to engage complementary profiles on the casing hanger and is wedged into engagement therewith by axial movement of the running nut, due to rotation of the stem, urging the wedge to expand the cam ring. A packoff assembly is threaded on external threads on the top of the casing hanger and is keyed to the wear bushing for rotational movement therewith. The wear bushing is likewise keyed to the plug so that rotation of the plug rotates the wear bushing and the packoff assembly.

The casing hanger, wear bushing and packoff assembly are lowered together into position within the wellhead on the running tool. In its initial landed position, the wear bushing is positioned without further movement being required and a flowby path is available during the circulating and cementing operations. After cementing has been completed, the running tool is released by rotation of the stem which raises the running nut, disengages the wedge from the expanded cam ring and allows the cam ring to disengage the casing hanger. The running nut is splined to the stem and is provided with a thread having a significantly high angle thread lead (helix) of 10° to 15° for rapid axial movement. A dead band area between the wedge and running nut allows considerable amount of axial movement of the running nut before disengagement of the wedge from the cam ring as a safety feature against accidental disengagement of the casing hanger and running tool. Continued rotation raises the running nut to its uppermost position where it becomes a driving element to rotate the plug and wear bushing to thread the packoff assembly downwardly into the annular seal region between the exterior of the casing hanger and the surrounding wellhead and to energize the packoff seal portion thereof to seal the annular seal region.

It will be apparent to those skilled in the art after a review of the drawings and the Detailed Description that the arrangement of this invention provides a means by which the diameter of the inner bore (ID) of the wear bushing and the inner bore (ID) of the casing hanger are substantially the same so that wear of one or the other will not differ significantly during subsequent operations in the well and that the high angle thread on the running nut is effectively a releasable thread that allows high torque to be applied to the running nut in its driving position, but also allows the running nut be be backed off from its driving position with much less torque being applied to facilitate preparing the running tool for reuse.

It will also become apparent that with this invention the running tool is capable of being released if desired, even though the packoff assembly has not been placed in proper sealing position, for whatever reason, to allow the running tool to be retrieved.

DETAILED DESCRIPTION

Figure 1:
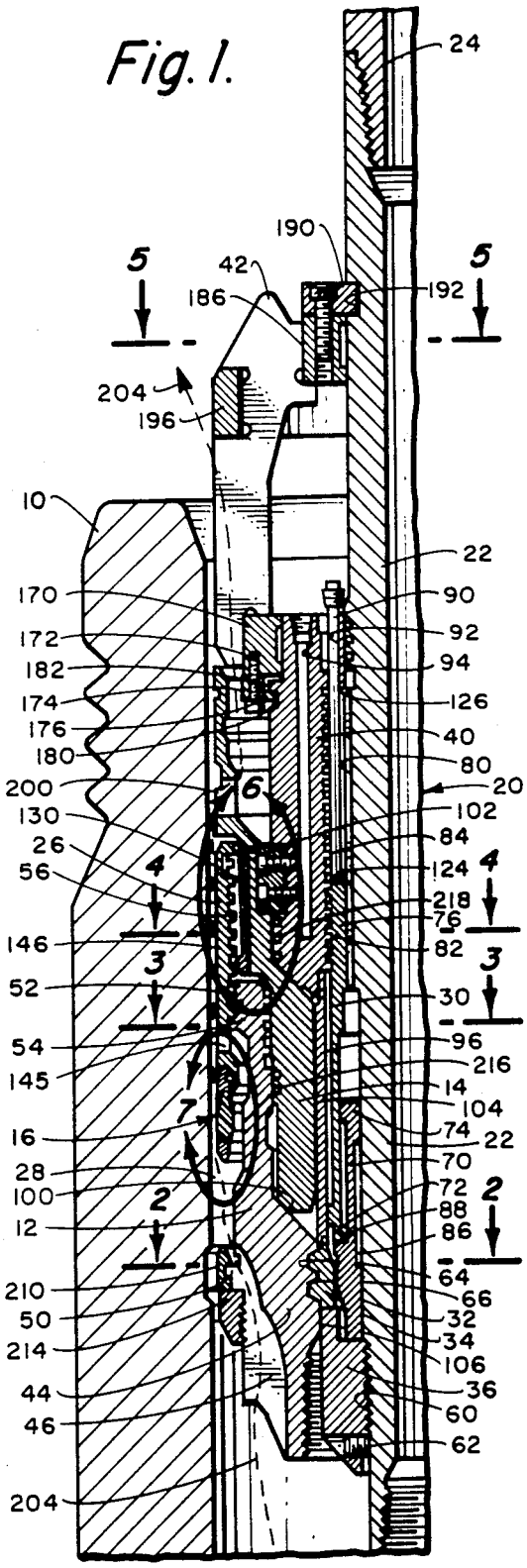
FIG. 1 is an elevational view, in section, illustrating the running tool, casing hanger, wear bushing and packoff assembly landed within a well housing.
Figure 2:
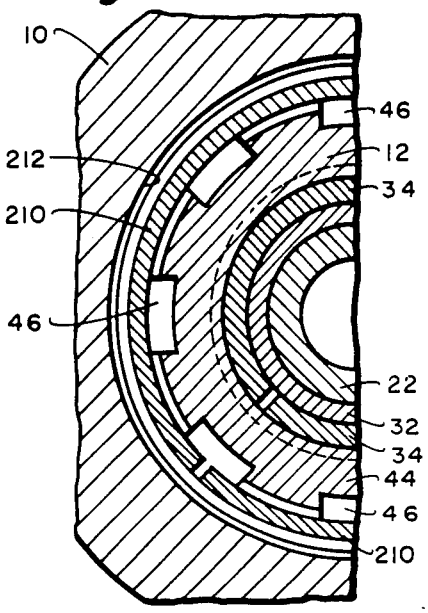
FIG. 2 is a cross-sectional view taken along line 2—2 of FIG. 1.
Figure 3:
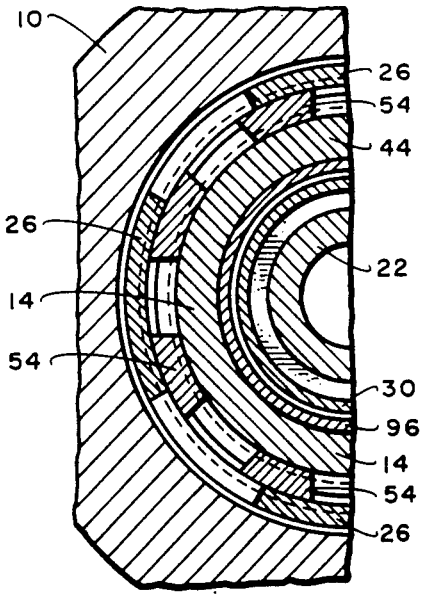
FIG. 3 is a cross-sectional view taken along line 3—3 of FIG. 1.

In FIG. 1 of the drawings, the invention is depicted already landed in the wellhead housing 10 with a casing hanger 12 shown supported on a suitable outwardly facing seat or shoulder (not shown) in the bore of the wellhead housing. The casing hanger 12, wear bushing 14 and packoff assembly 16 were assembled (made up) on a running tool 20 while on the vessel or platform and were lowered from the vessel or platform to the wellhead housing 10 by having a stem 22 connected by a tapered thread connection 24 to the lower one of a string of tubing, such as drill pipe. As shown, the wear bushing 14 is nested in the casing hanger 12 and the packoff drive nut 26 of the packoff assembly 16 is threaded on, and thus supported by, the casing hanger 12. In the position shown, circulating and cementing operations can be conducted in the usual manner. After completion of the cementing operation, the annular seal space 28, between the cylindrical inner wall or bore of the wellhead housing 10 and the opposing cylindrical wall of the casing hanger 12, is sealed by the packoff assembly 16.

The running tool 20 comprises the following components: the stem 22 with a running nut 30, a wedge 32, a cam ring 34 and a bottom nut 36 at the lower end thereof, a plug 40 and stabilizing fins 42 near the upper end of the stem 22. The running tool 20 with its attendant components are retrievable as will be understood from the description hereinafter.

The depicted casing hanger 12 is typical and comprises a main body section 44 provided with a cylindrical inner bore and circulating passages 46 and a packoff actuating shoulder 50. External threads 52 are located near the upper thin end section 54 of the casing hanger and shown in threaded engagement with internal threads 56 on the packoff nut 26. The threads 52 are right-handed so that right hand rotation of the wear bushing will lower the packoff nut toward the seal annulus 28.

The lower end of the running tool stem 20 supports the bottom nut 36 on external threads 60 on the stem. A set screw 62 holds the bottom nut 36 in place after the latter is threaded on the stem 20. This bottom nut 36 supports the cam ring 34 which is provided with an external latching profile 64 for engaging a complimentary internal latching profile 66 formed on the inner bore of the casing hanger. The cam ring 34 is a split ring and is biased out of engagement with the casing hanger latching profile, but is forced radially outwardly into engagement with the casing hanger profile by the wedge 32. This cam ring 34, when in engagement with the casing hanger profile 66, supports the casing hanger 12 on the running tool stem 22 together with the wear bushing 14 and packoff assembly 16. Retraction of the cam ring 34, on the other hand, not only permits initial assembly of the casing hanger and its supported equipment onto the running tool stem 22, but also allows disengagement of the running tool 20 for retrieval at the appropriate time. The outer diameters of the bottom nut and the cam ring in its collapsed position, respectively, are less than the internal bore of the wear bushing so that the bottom nut and cam ring are retrievable along with the rest of the running tool.

Figure 4:
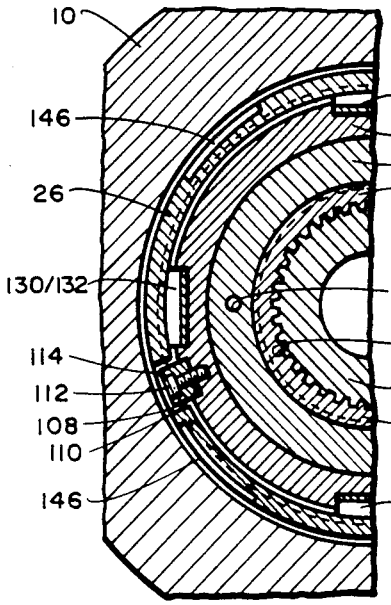
FIG. 4 is a cross-sectional view taken along line 4—4 of FIG. 1.

The wedge 32 is the lower enlarged end of an integral sleeve 70 which rotates freely on the outer periphery of the stem 22 and is moved in and out of engagement with the cam ring 34, i.e., moved axially of the stem 22, by the running nut 30. The running nut 30 is also a elongated sleeve with its lower end telescoped over the sleeve 70 of the wedge 32 and is provided with a radially inwardly extending rim 72 which is engagable with a radially outwardly extending rim 74 on top of the sleeve 70. The top portion 76 of the running nut 30 is keyed into an axial keyslot 80 formed on the outer periphery of the stem 22 so that rotation of the stem 22 will also rotate the running nut 30. FIG. 1 shows only one key slot 80, but there are several, as shown in FIG. 4. The external surface of the top portion 76 of the running nut 30 is provided with external threads 82 which threadably engage internal threads 84 of the plug 40.

The plug 40 is cylindrical with an inner bore spaced from the periphery of the stem 22 a distance sufficient to accommodate the top portion 76 of the running nut 30. During assembly of the casing hanger 12, wear bushing 14 and packoff assembly 16 on the running tool, this plug 40 is held stationary with respect to the stem 22 so that rotation of the stem 22 will thread the running nut 30 axially of the stem 22. Thus, rotation of the stem 22 to the left, i.e., counter clockwise as viewed from the vessel or platform, will move the running nut 30 downwardly so that the end 86 of the running nut 30 will engage a shoulder 88 between the wedge and sleeve 70 urging the cam ring 34 and its profile 64 into engagement with the profile 66 on the casing hanger 12. This is the position of the components in FIG. 1. The plug is provided with a position indicator in the form of a stick 90 located in a longitudinal throughbore 92. The stick engages the running nut 30 and provides an indication that the cam ring 34 is positioned correctly in the casing hanger profile 66. When the stick is not in use, it may be inserted in a blind bore 94 in the plug and the through bore 92 is suitably sealed as by a cap (not shown) to prevent a leakage path through the through bore. Also, the plug has a relatively thin tubular member 96, attached as by welding, which extends downwardly with the bore of the wear bushing and overlaps the top of the cam ring. This tubular member 96 protects the inner bore of the wear bushing at this time.

The wear bushing 14 is bell shaped and is supported on an upwardly facing conical surface 100 on the casing hanger between the main body section 44 and the upper thin end section 54 of the casing hanger 12 and is provided with an offset, relatively thin, relatively long, cylindrical neck portion 102. The inner bore 104 of the wear bushing is substantially the same as the inner bore 106 of the casing hanger so that neither will wear significantly different than the other during subsequent operations on the well. In the lower end of the neck portion 102, immediately above the casing hanger 12, is a key 108 (FIG. 4) fastened in a recess 110 in the wear bushing by a bolt 112 (one shown). Key 108 extends radially outwardly beyond the outer wall of casing hanger 12 to engage a keyslot 114 in the packoff drive nut 26. As more clearly shown in FIG. 6, on the inner side of the wear bushing and above the first mentioned key 108 is a keyslot 116 to receive a second key 118 fastened in a recess 120 to the plug 40 by bolts 122 so that rotation of the plug 40 will transmit torque through the key 118 to the wear bushing 14 which, in turn, will rotate the packoff assembly 16 via the first key 108. Again, while only one set of key/key slots are shown, more such sets are provided around the periphery of the components.

Thus, as mentioned previously, counter-clockwise rotation of the stem 22 will move the running nut 30 axially downwardly against the wedge 32 to urge the cam ring 34 outwardly and into engagement with the casing hanger. Clockwise rotation of the stem 22, on the other hand, will thread the running nut 30 upwardly so that its rim 72 will eventually engage the rim 74 of the wedge sleeve 70 pulling the wedge 32 upwardly and out of engagement with the casing hanger. The dead band or free axial movement of the running nut 30 upwardly for some distance before running nut rim 72 engages the rim 74 of the wedge sleeve, provides a safety factor against accidental release of the running tool for the casing hanger. Also, the splines together with the high lead threads 82 and 84 on the running nut and plug provide a rapid transport and thus rapid release of the running tool from the casing hanger. The continued rotation of the stem 22 and continued upward movement of the running nut 30 will cause the top end 124 of the running nut 30 to engage a shoulder 126 on the plug 40. Since further rotation is prevented when the running nut 30 is in this position, the running nut 30 becomes a driving element whereby continued rotation of the stem will drive the plug 40 to ultimately transmit rotational movement to the packoff assembly 16. It is also pointed out that due to the high pitch of the threads 82 and 84, the running nut will not be tightly engaged in its position against the shoulder 126 such that the running nut can be easily broken out for further use of the running tool despite the high torque applied through the running nut to set the packoff seal.

Figure 6:
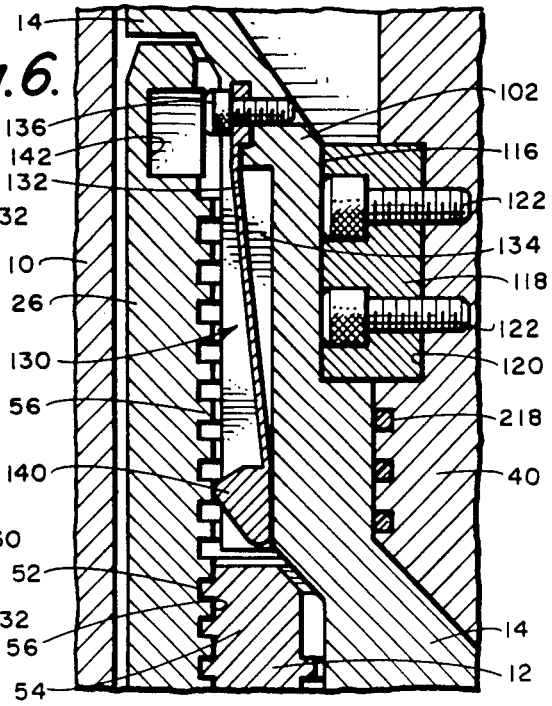
FIG. 6 is an enlarged view of the detail of the latching mechanism and key in the wear bushing in the area surrounding by the arrow 6 in FIG. 1.

The wear bushing neck portion 102 adjacent the key 108 has a latching mechanism 130. One is shown in FIGS. 6 and 9, although more are shown disposed around the wear bushing in FIG. 4. This latching mechanism 130 comprises a relatively flat leaf spring 132 positioned in a recess 134 in the wear bushing 14 and fastened to the wear bushing by screw 136. The leaf spring 132 has a radially outwardly extending finger 140 which engages the inner wall (threads 56) of the packoff drive nut 26 and is held in retracted position against the bias of the leaf spring 132 when the packoff drive nut 26 is in the position as shown in FIG. 1 and FIG. 6. When the packoff drive nut 26 is driven to its packoff set position, the bias of the leaf spring 132 will urge the finger 140 into a slot 142 formed in the top of the packoff drive nut 26, thus latching the wear bushing 14 to the packoff assembly 16 (see FIGS. 8 and 9). The bias of the leaf spring 132 will not prevent disengagement and retrieval of the wear bushing 14 by a subsequent running tool operation. The wear bushing is provided with J-slots (not shown) for connection to a tool to retrieve the bushing when desired.

Figure 7:
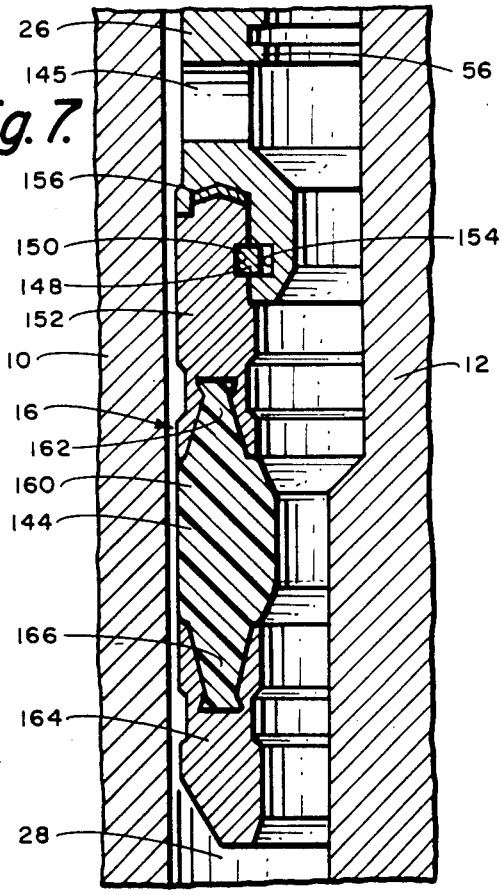
FIG. 7 is an enlarge detail of part of the packoff assembly in the area encircled by arrow 7 in FIG. 1.

The packoff assembly 16, as more clearly shown in FIG. 7, includes the packoff drive nut 26 with internal threads 56 in engagement with the external threads 52 on the casing hanger and a packoff seal portion 144 connected to the packoff drive nut 26. The drive nut is also provided with ports 145 and passages 146 for flowby during the cementing operation. While the packoff seal portion 144 is conventional, and more fully described in the U.S. Pat. No. 3,797,864, supra, it can be seen to includes a swivel connection accomplished by a split retainer ring 148 (FIGS. 3, 4, 7 and 8) mounted in an internal groove 150 in a support ring 152 and an external groove 154 in the packoff drive nut 26. A thrust bearing 156 is provided between the packoff drive nut 26 and the support ring 152 so that the packoff drive nut 26 can be rotated without rotating the support ring 152. The lower end of the support ring 152 engages and supports the upper end of a cylindrical resiliently deformable packing ring 160 by a dovetail connection 162. A lower abutment ring 164 is connected to the packing ring 160 by a dovetail connection 166.

Figure 5:
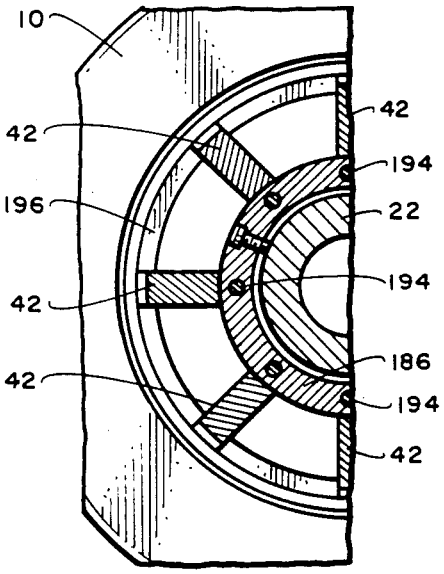
FIG. 5 is a cross-sectional view taken along line 5—5 of FIG. 1.
Figure 8:
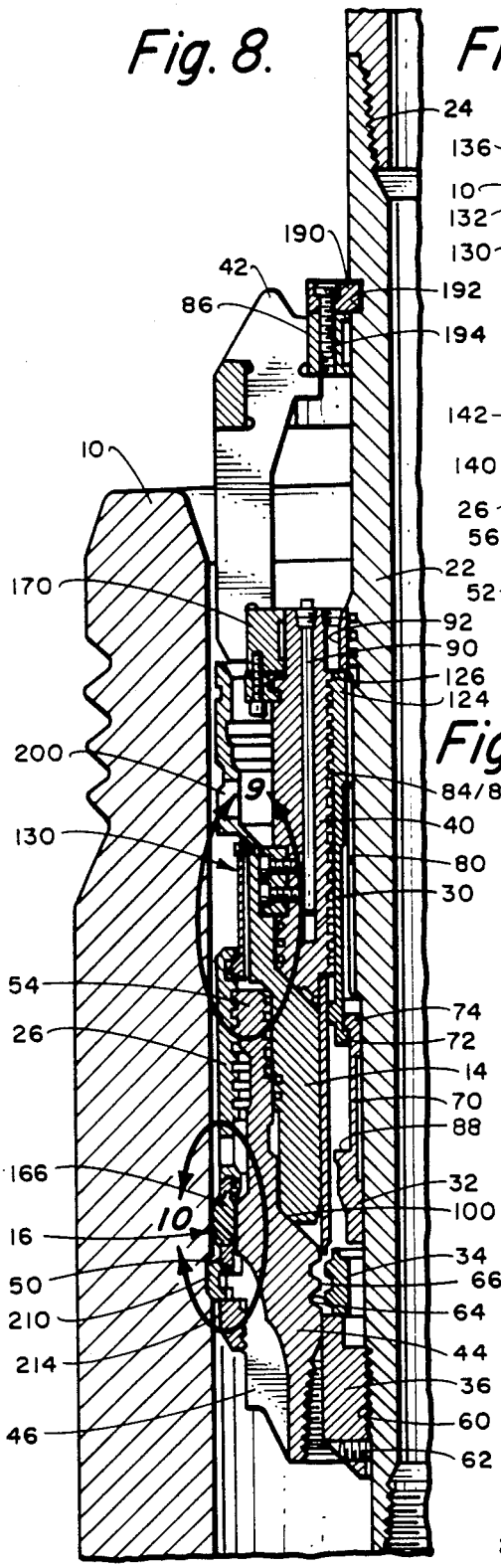
FIG. 8 is an elevational view in section illustrating the packoff assembly having landed and the casing hanger being free of the running tool.
Figure 9:
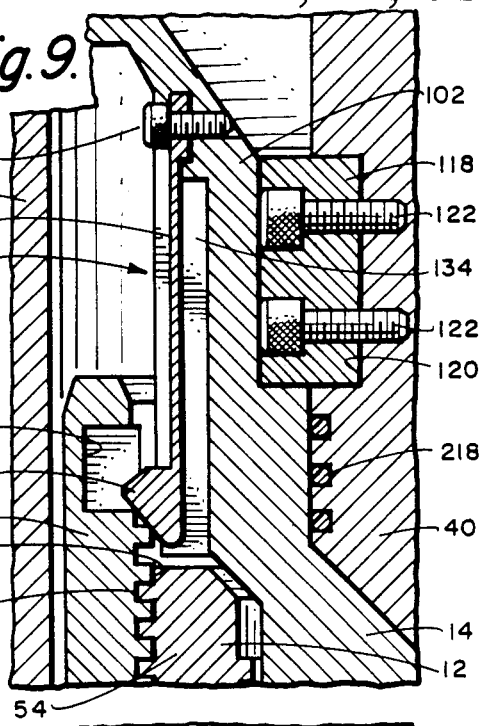
FIG. 9 is an enlarged detailed view similar to FIG. 6 showing the latching mechanism having latched the packoff drive ring to the wear bushing in the area encircled by the arrow 9 of FIG. 8.

Attention is now directed to FIGS. 1, 5 and 8 and to the top of the plug 40 and running tool stem 22.

The centralizer fins 42 are radially outwardly extending, relatively thin plates, each fixed, as by welding, at its lower end to a retaining ring 170 which surrounds and engages the plug 40. The ring 170 is connected to the plug 40 by a plurality of bolts 172 through a split ring 174 with a rim 176 in a suitable groove 180. Groove 180 thus forms a flange 182 between the rim 176 and the retainer ring 170 to latch the fins 42 to the plug. The upper end of the plates are each provided with a second retainer ring 186, attached as by welding thereto, surrounding and engaging the stem. Ring 186 is similar to ring 170 and like ring 170 has a split ring 190 seated in a groove 192 in the stem. Split ring 190 is attached to ring 186 by bolts 194. The ring/bolt/groove assemblies 170–194 attach the centralizer fins to the plug 40 and stem 22. The centralizer fins are L-shaped in elevation as shown in FIG. 1 and extend radially outwardly to engage the inside surface of the wellhead housing and serve to space and orient the running tool 20 vertically within the wellhead as well as to act as a bushing between the stem and the wellhead housing bore. A protector ring 196 surrounds the fins to protect and help maintain the fins oriented. The centralizer fins via the ring/bolt/groove assemblies 170–194 also serve to retain the plug in position relative to the stem 22.

From the foregoing, it can be seen that for certain circulating and cementing operations, there is a flowby through the passages 46, the annular seal area 28, the ports 145 and passages 146 in the packoff drive nut (FIGS. 1, 3, 7 and 8) through the ports 200 in the wear bushing and out through the spaces between the centralizer fins. This is represented by the arrow 204 in FIG. 1.

Figure 10:
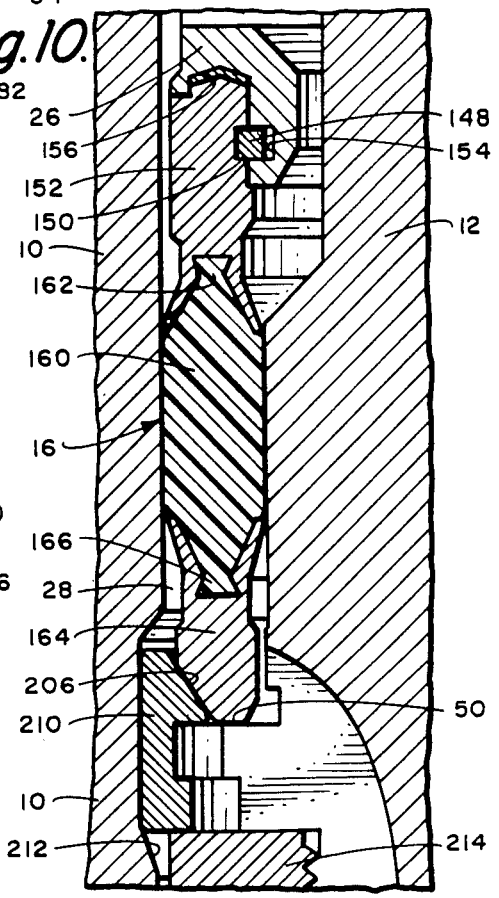
FIG. 10 is an enlargement of the area encircled by arrow 10 in FIG. 8 and showing the packoff assembly sealed in the seal annulus.

Again, after the circulating and cementing operation, clockwise rotation of the stem 22 will cause upward movement of the running nut 30 on the threads on the plug 40 and at the same time a downward movement of the packoff assembly 16 by reason of rotation of the running nut 30, plug 40 and wear bushing 14. Continued rotation of the stem 22 will cause the packoff drive nut 26 to engage the lower seat 50 on the casing hanger and expand the elastomeric seal 160 thus sealing the angular seal area 28 against leakage. This is depicted in FIG. 10. The lower abutment ring 164 also engages a conical shoulder 206 on a split ring 210 to urge the latter into a groove 212 in the wellhead housing 10 to lock the casing hanger within the well bore. The split ring 210 is supported on a ring 214 threaded on the casing hanger.

At this time, the efficacy of the seal is tested by pressurizing the area above the running tool, etc. The O-ring seals 216 between the casing hanger and wear bushing (two seals shown) and O-ring seals 218 between the wear bushing and plug (three shown) prevent leakage between these named components so that the seal of the set packoff can be tested.

It should be pointed out also at this time that rotation of the packoff drive could begin before the running nut reaches its uppermost position due to friction, debris, etc., causing the plug and wear bushing to rotate, but in any event, as the packoff assembly begins to set, this frictional phenomena will be overcome and the running nut will continue to thread upwardly until it reaches its uppermost position where it becomes a drive element. The ability of the running tool to be released prior to the setting of the packoff also has the advantage of retrieving the running tool in the event the packoff cannot be properly set for whatever reason.

The running nut 30, in the meantime, has freed the cam ring 34 of engagement with the casing hanger so that the plug 40, running nut 30, wedge 32, cam ring 34 and bottom nut 36 are now free to be withdrawn.

I claim:

1. An apparatus for supporting a tubular string extending into a well bore from a surrounding wellhead, comprising;

hanger body means adapted to be located in the wellhead and having at least external threads and at least one sealing surface thereon;

wear bushing means adapted to be located in the wellhead;

packoff means adapted to be located in the wellhead;

running tool means connectible to a running string;

means releasably connecting said hanger body means, wear bushing means, and packoff means to said running tool means to enable said hanger body means, wear bushing means, and packoff means to be lowered into said wellhead; and means for moving said packoff means downwardly of said hanger body means toward said sealing surface and effecting sealing engagement of said packoff means with said sealing surface and said surrounding wellhead without downward movement of either said hanger body means or said wear bushing means.

2. The apparatus as claimed in claim 1, wherein said sealing surface is a cylindrical wall spaced from an inner cylindrical wall of said wellhead, thus defining an annular seal area.

3. The apparatus as claimed in claim 1 wherein said hanger body means and said wear bushing means have inner bores which are substantially equal.

4. The apparatus as claimed in claim 1 wherein said means releasably connecting said hanger body means, wear bushing means, and packoff means to said running tool means comprises cam ring means, wedge means, and threaded means for moving said wedge means into one position where said cam ring means is latched to said hanger body means and to a second position where said cam ring means is unlatched from said hanger body means to allow said running tool means to be released from said hanger body means.

5. The apparatus as claimed in claim 4 wherein said threaded means comprises running nut means fixed to said running tool means to rotate therewith and moveable axially thereof.

6. The apparatus as claimed in claim 5 wherein said running nut means is moveable axially on said running to means independently of said wedge means a distance before moving said wedge means into said one position by rotation of said running tool means in one direction and moveable axially independently of said wedge means while said wedge means is at said one position before moving said wedge means to said second position by rotation of said running tool means in a second direction.

7. The apparatus as claimed in claim 6 wherein said running tool means is moveable still further after moving said wedge means to said second position, to a position where said running nut means becomes part of said means for moving said packoff means downwardly.

8. The apparatus as claimed in claim 7 wherein said running tool means includes stem means with axial splines thereon, a cylindrical plug means telescoping said stem means, but spaced therefrom sufficiently to allow said running nut means to pass between said stem means and said plug means, said plug means having internal threads engageable with external threads on said running nut means, and axial splines on said running nut means engageable with said axial splines in said stem means.

9. The apparatus as claimed in claim 8 wherein said packoff means is supported on said hanger body means by said external threads on each hanger body means engageable with internal threads on said packoff means.

10. The apparatus as claimed in claim 9 such that when said running nut means becomes part of said means for moving said packoff means downwardly, rotation of said stem means in said second direction rotates said running nut means, plug means and wear bushing means to thread said packoff means on said hanger body means.

11. The apparatus of claimed in claim 10 further including means on said wear bushing means for latching said packoff means when said packoff means effects sealing engagement with said sealing surface.

12. The apparatus as claimed in claim 4 further including means for indicating that the wedge means has been moved to said one position.

13. The apparatus as claimed in claim 8 wherein said threads on said running nut and said plug are helical in the range of 10° to 15°.

14. Apparatus for supporting a tubular string extending into a well bore from a surrounding wellhead, comprising;

a casing hanger adapted to be located in the wellhead and having a sealing surface;

a wear bushing partly nestable within said casing hanger;

a packoff assembly;

a running tool connectible to a running string;

a first means releasably connecting said casing hanger body to said running tool to enable said casing hanger to be lowered into the wellhead together with said wear bushing and packoff assembly;

a second means connecting said packoff assembly to said casing hanger initially positioning said packoff assembly above sealing surface, both of said first and second means being responsive to actuation by said running tool to release said casing hanger from said running tool and move said packoff assembly relative to said casing hanger and to effect sealing engagement of said packoff assembly with said sealing surface and said wellhead while said casing hanger and wear bushing remain axially stationary with respect to said well head.

15. A method of lowering a casing hanger together with a wear bushing and sealing said casing hanger in a wellhead comprising the steps of;

attaching apparatus onto a running tool which has a casing hanger, a wear bushing, and a packoff assembly thereon, connecting said running tool and apparatus onto means for lowering and rotating said running tool into a wellhead located subsea, positioning said casing hanger and wear bushing in said wellhead, said casing hanger and wear bushing being adapted for that purpose, rotating said running tool to release said casing hanger, wear bushing, and said packoff assembly from said running apparatus and lowering said packoff assembly with respect to said wellhead to seal said casing hanger with respect to said wellhead while said casing hanger and wear bushing remain axially stationary with respect to said wellhead.

16. The method of claim 15 wherein said running tool is raised from said wellhead.

17. The method of claim 15 further including the step of providing said running tool with a means for enabling said running tool to be rotated in a direction opposite the rotational direction of the above-mentioned rotational step upon the application of less torque than was required to lower said packoff assembly and to seal said casing hanger with respect to said wellhead in the above-mentioned rotational step.

* * * * *